United States Patent [19]

Fairbairn

[11] Patent Number: 4,747,762

[45] Date of Patent: May 31, 1988

[54] FLUID MACHINE

[75] Inventor: George A. Fairbairn, Victoria, Australia

[73] Assignee: Fairbairn International PTY. Ltd., Melbourne, Australia

[21] Appl. No.: 832,509

[22] Filed: Feb. 20, 1986

Related U.S. Application Data

[63] Continuation-in-part of Ser. No. 569,708, Jan. 10, 1984, abandoned.

[30] Foreign Application Priority Data

Jan. 10, 1983 [AU] Australia ..... PF7548

[51] Int. Cl.[4] ..... F04C 18/00; F04C 29/00

[52] U.S. Cl. ..... 418/191; 418/152; 418/179

[58] Field of Search ..... 418/191, 206, 152, 179, 418/192–195

[56] References Cited

U.S. PATENT DOCUMENTS

| | | | |
|---|---|---|---|
| 1,064,169 | 6/1913 | Prall | 418/191 |
| 1,818,882 | 8/1931 | Demuynck | 418/191 |
| 2,188,752 | 1/1940 | Houghton | 418/191 |
| 2,883,001 | 4/1959 | Dierksen | 418/191 |
| 3,255,630 | 6/1966 | Karlby | 418/191 |
| 3,396,667 | 8/1968 | Schmitt | 418/152 |
| 3,602,617 | 8/1971 | Takahashi | 418/206 |
| 3,801,241 | 4/1974 | Martin | 418/152 |
| 3,859,014 | 1/1975 | Dworak | 418/152 |

FOREIGN PATENT DOCUMENTS

| | | | |
|---|---|---|---|
| 159800 | 6/1983 | German Democratic Rep. | 418/77 |

*Primary Examiner*—Carlton R. Croyle
*Assistant Examiner*—Jane E. Obee
*Attorney, Agent, or Firm*—Sughrue, Mion, Zinn, Macpeak & Seas

[57] ABSTRACT

A fluid machine comprises two rotors, one rotor having at least one projection which engages within a recess within the other rotor. During operation, fluid passes between the first rotor and a peripheral surface of a working chamber within which the rotors are mounted. A fluid inlet and a fluid outlet are so arranged as to face generally in the direction in which the fluid moves around the first rotor. Pressure-equalization passages are provided in the rotors, and extend between the opposed axial faces of the rotors whereby, to equalize the fluid pressure at the axial faces. The machine may be used as a pump for water and other liquids.

1 Claim, 7 Drawing Sheets

FLUID MACHINE

RELATED APPLICATIONS

The present application is a continuation-in-part of application No. 569,708 filed Jan. 10, 1984, now abandoned.

BACKGROUND OF THE INVENTION (1.) Field of the Invention

This invention relates to a fluid machine.

(2.) Description of the Prior Art

There have been proposed fluid machines comprising two rotors mounted within a working chamber for rotation about parallel axes. One of the rotors comprises radially outwardly directed projections which engage within recesses within the other rotor. The present invention concerns fluid machines, that is, pumps or motors, of this type and it is to be noted that this type of machine differs from so-called gear pumps or motors which comprise two intermeshing toothed rotors. Prior designs of this type of machine have tended to be relatively inefficient in operation.

Prior designs of fluid machine of the type with which the present invention is concerned are described for example in U.S. Pat. Nos. 176,278 and 230,862. U.S. Pat. Nos 1,096,186 and 1,475,683 are examples of patents relating to gear type pumps or motors.

SUMMARY OF THE INVENTION

According to the present invention there is provided a fluid machine comprising a casing having a working chamber therein, first and second rotors mounted in the chamber for rotation about respective parallel axes, means for synchronising rotation of the two rotors, the first rotor comprising a circumferential surface of rotation with at least one projection extending radially outwardly of said surface, the second rotor comprising a circumferential surface of rotation with at least one recess shaped to receive the projection during rotation of the two rotors, said circumferential surfaces co-operating to define a fluid barrier between the two rotors, an inlet arranged to discharge fluid into the working chamber in the zone defined between the surfaces of rotation of the two rotors at one side of the fluid barrier and the peripheral surface of the working chamber, said inlet being arranged to direct said fluid generally in a direction such that the fluid moves around the axis of the first rotor between the surface of rotation of the first rotor and the peripheral surface of the working chamber in a direction away from the barrier, a fluid outlet arranged to receive fluid from the zone defined between the surface of rotation of the two rotors at the other side of the barrier and the peripheral surface of the working chamber, said outlet being orientated to face generally in the direction in which the fluid is moved around the axis of first rotor, and means defining passages passing through the rotors from one axial side to the other whereby to equalise the pressure on the two opposed axial sides of the rotors.

Further according to the invention there is provided a fluid machine comprising a working chamber having a peripheral surface, first and second rotors in said chamber for rotation about parallel axes, the first rotor comprising a substantially smooth circumferential surface with a projection extending radially outwardly from said surface, said projection having a tip in substantial sealing relation with the peripheral surface of the chamber, the second rotor comprising a substantially smooth circumferential surface with a recess leading from the circumferential surface, the circumferential surface of the second rotor being in substantial sealing relation with the peripheral surface of the chamber, said projection entering the recess during rotation of the rotors, and said circumferential surfaces co-operating to define a fluid barrier therebetween, means defining a fluid inlet leading into the working chamber to direct fluid between the circumferential surface of the first rotor and the peripheral surface of the chamber at one side of the fluid barrier, and a fluid outlet leading from the working chamber at the other side of the fluid barrier, said inlet and outlet facing generally in the direction of fluid movement within the working chamber, in the adjacent zone of the working chamber.

BRIEF DESCRIPTION OF THE DRAWINGS

An embodiment of the invention will now be described by way of example only with reference to the accompanying drawings, in which.

DESCRIPTION OF THE PREFERRED EMBODIMENTS

Figure 1:
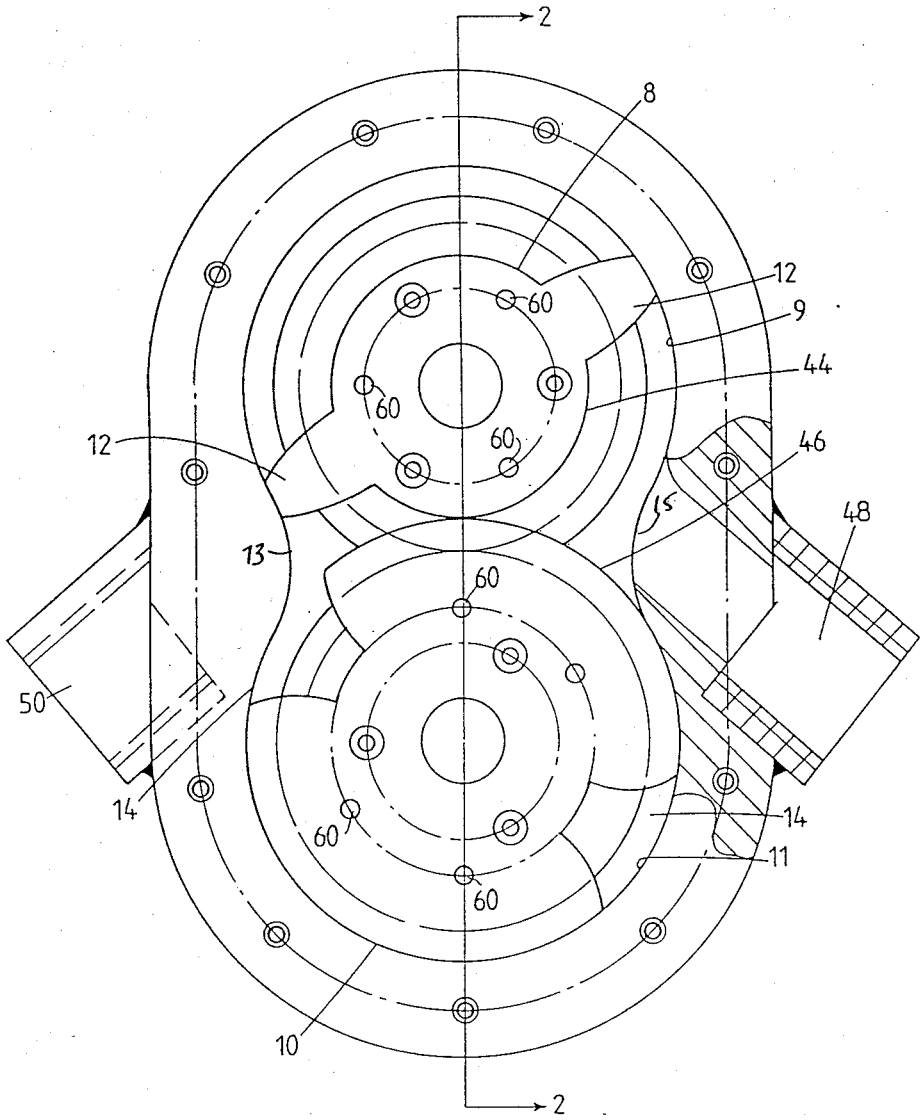
FIG. 1 is a side elevation of a fluid machine in accordance with a first embodiment of the invention with part of the casing removed to reveal the internal structure.
Figure 2:
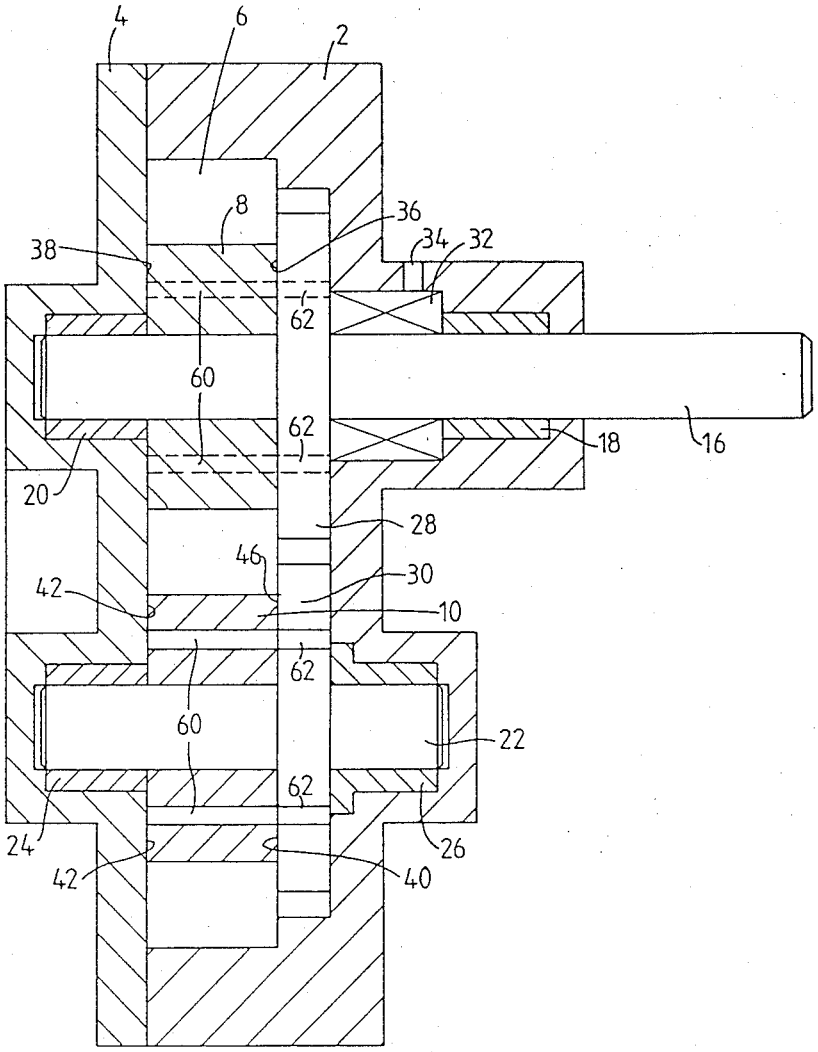
FIG. 2 is a section of the complete fluid machine on line 2—2 of FIG. 1.

The machine illustrated in FIGS. 1 to 7 is arranged for use as a pump for water or other liquid but it is to be understood that the machine could be used as a fluid motor if a pressurised supply of fluid were supplied to the machine.

The pump has a casing which is formed by a main body 2 and a cover plate 4. The main body 2 is of generally hollow shape and has a working chamber 6 formed therein. Located within the chamber 6 are first and second rotors 8 and 10, the rotor 8 being provided with diametrically opposed projections which have sides of involute form. It will be noted that when viewed in side elevation, each projection 12 progressively reduces in width from its root to its tip. The second rotor 10 is formed with diametrically-opposed recesses 14, the arrangement being such that on counter-rotation of the rotors 8 and 10, the projections 12 enter the recesses 14. The sides of the recesses 14 are of involute form complementary to that of the projections 12 and which engage the sides of the projections 12, while the projections 12 are within the recesses 14. The chamber 6 has part-cylindrical peripheral surfaces 9 and 11 which engage (or clear by a small distance, for example less than 1mm) the tips of the projections 12 and the cylindrical surface of the rotor 8. The surfaces 9 and 11 are smoothly interconnected by convex interconnecting surfaces 13 and 15 which are provided to avoid the sharp projections which would otherwise be formed by the intersection of the surfaces 9 and 11.

The first rotor 8 is mounted upon a shaft 16 which is supported by bearings 18 and 20 let into the main body 2 and the plate 4. One end of the shaft 16 projects from the body 2 and is, in use, driven by a suitable power source in order to provide the torque for driving the pump. The second rotor 10 is mounted on a shaft 22 which is supported by bearings 24, 26 let into the plate 4 and body 2 respectively.

The shafts 16 and 22 are constrained to rotate in a 1:1 relationship in opposite directions by means of intermeshing gears 28 and 30 mounted on the shafts 16 and 22 respectively. In the illustrated arrangement the gears 28 and 30 are within the casing and are bolted or screwed to the respective rotors 8 and 10. A face seal 32 is located between the gear 28 and bearing 18 and serves to prevent fluid from the working chamber entering the bearing 18. The face seal 32 is preferably in the form of a hollow bellows moulded from plastics material. In the event that some fluid does pass the fluid seal 32, a bleed hole 34 is provided so as to permit the fluid to escape from the casing rather than enter the bearing 18. In an alternative arrangement, the gears could be located outside the casing but in that case an additional face seal would be required.

Figure 4:
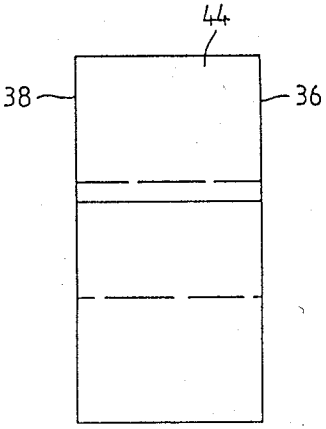
FIGS. 3 and 4 are, respectively, a side elevation and end elevation showing in greater detail, one of the rotors of the machine.
Figure 3:
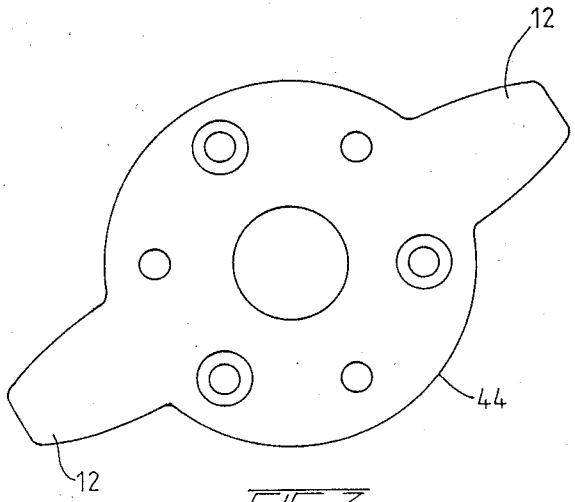
Figure 6:
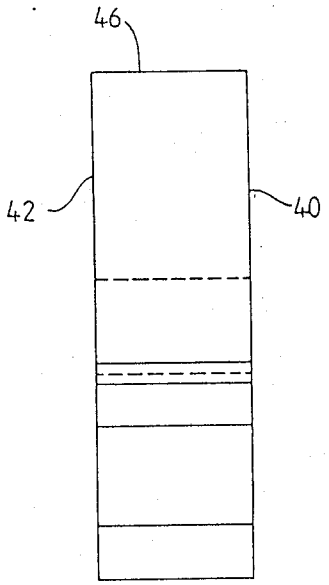
FIGS. 5 and 6 are, respectively, a side elevation and end elevation showing in greater detail the other rotor of the machine.
Figure 5:
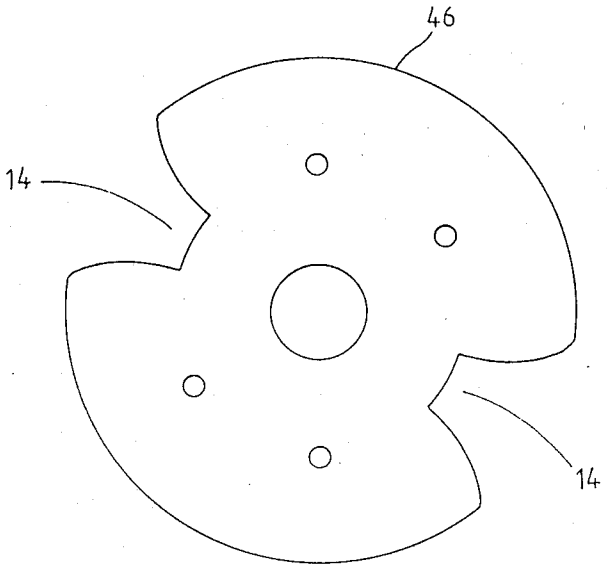
Figure 7:
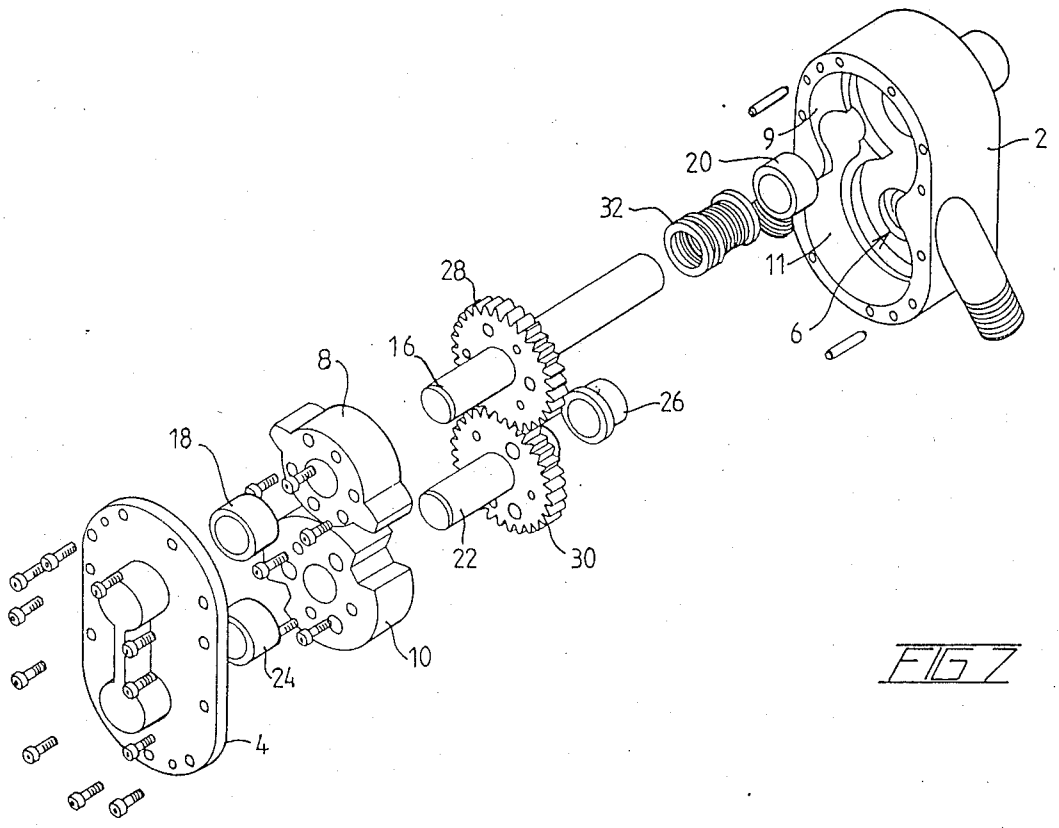
FIG. 7 is an exploded view of the machine.

As best seen in FIGS. 3 and 4, the first rotor 8 is of disc-like form with a smooth circumferential surface which is defined by a surface of rotation with the projections 12 extending radially outwardly therefrom. Specifically as shown, the circumferential surface is cylindrical. The arrangement is such that its axial faces 36 and 38 engage or lie closely adjacent to the gear 28 and the plate 4 respectively. Similarly, as shown in FIGS. 5 and 6 second rotor 10 is also of disc-like shape and its axial faces 40 and 42 engage or lie closely adjacent to the gear 30 and plate 4 respectively. The circumferential surface of the rotor 10 is also smooth and, as shown, is cylindrical. In the figures, the cylindrical surface of the rotor 8 is designated 44, and that of the rotor 10 is designated 46, the surfaces 44 and 46 being arranged to engage one another or lie so closely adjacent to one another as to form a substantially fluid-tight barrier therebetween. The tips of the projections 12 engage or lie closely adjacent to the peripheral surface of the chamber 6 and the cylindrical surface 46 of the second rotor 10 engages or lies closely adjacent to the peripheral surface of the corresponding part of the chamber 6.

It has been determined that only two projections 12 and two recesses 14 provide optimum effects while maintaining a simple construction. It would, however, be possible to provide alternative constructions with, say, three projections and recesses and which would still operate with good efficiency.

The pump has an inlet 48 and an outlet 50 for the fluid to be pumped for anticlockwise rotation of the first rotor (as viewed in FIG. 1); for clockwise rotation of the first rotor 48 becomes the outlet and 50 the inlet.

The operation of the pump is as follows. When the shaft 16 is driven so as to rotate the first rotor 8, in the counter clockwise direction as seen in FIG. 1, the projections 12 will cause fluid at the inlet to be drawn into the chamber and move in a generally counter clockwise direction within the chamber. Fluid does not pass directly to the outlet 50 because of the fluid barrier between the rotors 8 and 10. The arrangement is such that the projection 12 will enter the recess 14, the profiles of the projection 12 and recess 14 being arranged so as to substantially maintain at least one point of contact during the period whilst the projection is within the recess. At this point, the fluid which had just entered the chamber 6 will now, generally speaking, be under the influence of both of the projections 12 and further rotation of the shaft 16 will displace the fluid around the chamber until the point where the leading projection passes the outlet 50 and the fluid will then pass out of the outlet.

The inlet 48 discharges into the zone defined between the peripheral surface of the chamber 6 and the cylindrical surfaces 44 and 46 of the rotors 8 and 10, at one side of the fluid barrier defined by the surfaces 44 and 46, the inlet being so orientated that it directs the fluid generally in a direction such that the fluid moves around the rotor 8 in a direction away from the fluid barrier. Likewise, the outlet 50 communicates directly with the opposite zone defined between the peripheral surface of the chamber 6 and the cylindrical surfaces of the rotors 8 and 10 at the other side of the fluid barrier, the outlet being so oriented that it faces generally in the direction of the fluid being moved around the rotor 8. This configuration of the inlet and outlet contributes significantly to the efficiency of the pump. It will be noted, in particular, that the inlet and outlet are symmetrically arranged about a plane containing the axes of the two rotors and are angularly displaced about the axis of the rotor 8, by an angle of substantially 270° between the inlet and outlet.

The profiles of the projections 12 and recesses 14 as described earlier obviate the trapping of fluid within the recess at the outlet side, when the projection moves into the recess. Instead, fluid within the recess 14 in the zone of the outlet is progressively expelled from the recess by the projection when the projection moves into the recess. This is of significance because the trapping of fluid within the recess by the projection would tend to lower the efficiency of the pump. Similarly, at the inlet side, the projection moves out of the recess without creating a closed vacuum pocket within the recess.

The rotors 8 and 10 have a number of holes 60 therethrough which align with holes 62 in the gears 28 and 30. The function of these holes is to equalise the pressure on either axial side of the rotors 8 and 10 so as to eliminate build-up of side thrusts on the rotors and gears which would tend to increase friction against the casing and thus make rotation more difficult with a consequent reduction in efficiency.

In a further modification, it would be possible to arrange for the inlet and outlet 48 and 50 to pass through the cover plate 4 so as to enable a more tangential orientation relative to the annular flow path for the fluid. This would further assist in ensuring that the direction of flow in the inlet and outlet flows in the same general direction as the fluid in the annular path adjacent to the inlet and outlet respectively.

A prototype of the invention has been constructed and found to perform most satisfactorily. In the prototype, the shafts were made of stainless steel, the casing formed from aluminium or plastics material, the rotary members from the plastics material such as Nylon the bearings made from plastics material such as "Delrin", and the seal 32 comprising a ceramic water pump seal similar to those used in automobiles. The casing was approximately 21.5×14.7×6.4 cm and was capable of pumping up to 4000 gallons/hr when rotated at 2000

RPM the inlets and outlets being about 3.8 cm in diameter. The same pump could also be operated satisfactorily at 500 RPM or could be operated by hand at lower rotational speeds.

In the pump described herein, the pumping action is provided by the two projections 12. Although the pump does include gears, these are provided only for the purpose of synchronising the two rotors and they do not take a direct part in the pumping action as such, in contrast to the actions which occur in a conventional gear pump. The operative part of the working chamber of the pump, namely the part around the first rotor between the inlet and outlet is not reduced in volume by gear teeth projecting from the circumferential surface of the first rotor and which would have the effect of reducing the volume of fluid pumped per revolution. The fluid machine described herein is of simple and robust construction and is efficient in operation.

Figure 8:
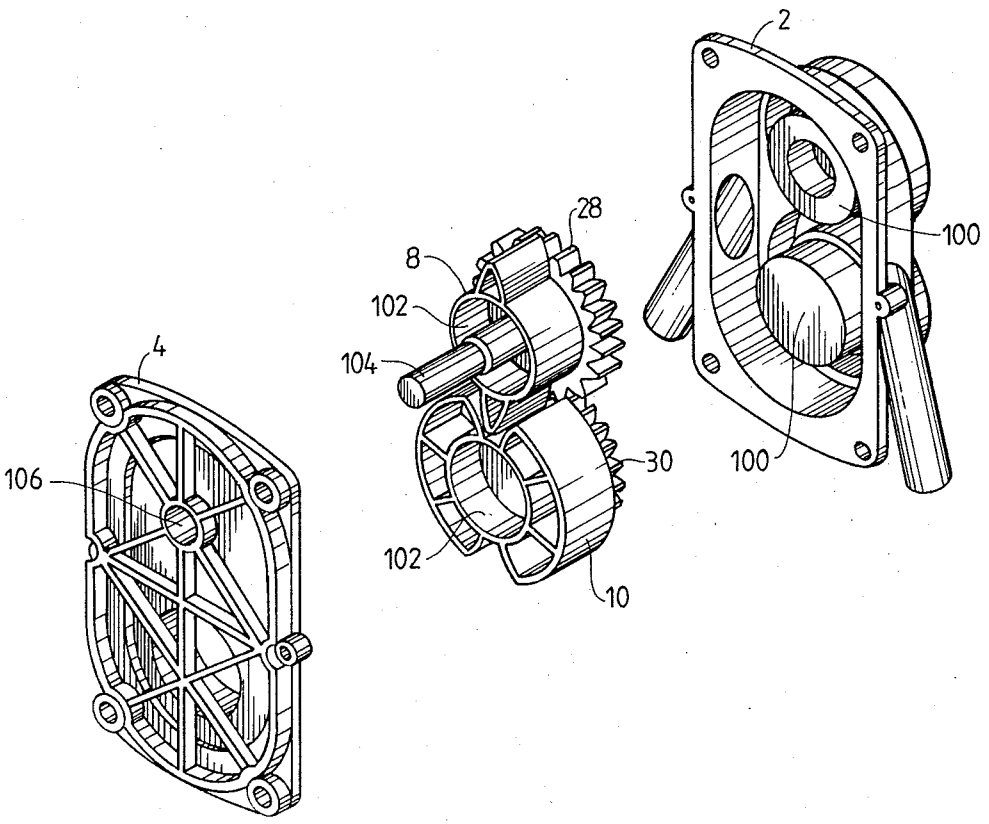
FIG. 8 is an exploded view of a second embodiment of the invention.
Figure 9:
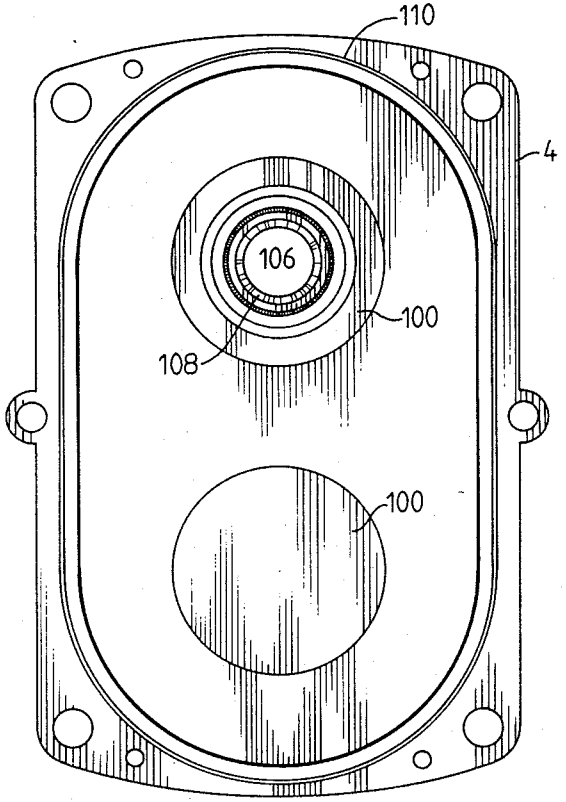
FIG. 9 is an elevation of one of the casing halves of the second embodiment.

In the embodiment shown in FIGS. 8 and 9, the first rotor 8 is molded integrally with gear 28 as a unitary molding of a suitable plastics. The second rotor 10 is likewise molded integrally with gear 30 as a unitary molding of a suitable plastics. The two casing halves 2 and 4 each comprise unitary plastics moldings with integral inwardly directed bearing bosses. The end faces of the combined rotor/gear moldings 8, 28 and 10, 30 include cylindrical recesses 102 which fit over the bearing bosses 100 whereby the bosses provide bearing support for the rotor/gear moldings. The first rotor 8 is molded onto or is otherwise drivingly attached to an input shaft 104 which projects outwardly through a central aperture 106 in the corresponding bearing boss in the casing half 4, a suitable seal or packing 108 being incorporated within the aperture 106 to prevent fluid leakage externally of the casing. The inner face of the casing half 4 includes a peripheral groove which receives a sealing ring 110 to provide a fluid-tight seal with the flange of the casing half 2 when the two halves are bolted together.

The embodiment of FIGS. 8 and 9 thus comprises four main moldings, the input shaft and two seals. Accordingly, the pump may be produced and assembled inexpensively, and any worn parts may be replaced without difficulty.

Many modifications will be apparent to those skilled in the art without departing from the spirit and scope of the invention as defined in the appended claims.

I claim:

1. In a fluid pump comprising a casing having a working chamber therein, first and second rotors mounted in the chamber for rotation about respective parallel axes, means for synchronising rotation of the two rotors, the first rotor having a surface of rotation with at least one projection extending radially outwardly of said surface, and the second rotor having a surface of rotation with at least one recess shaped to receive the projection during rotation of the two rotors, an inlet for directing fluid into the working chamber, and an outlet for discharging fluid from the working chamber, the first rotor haivng two of said projections disposed 180° apart around the periphery of the first rotor, the second rotor having two of said recesses disposed 180° apart around the periphery of the second rotor, each said projection engaging within a respective one of the recesses during rotation of the two rotors with the projection and corresponding recess having complementary profiles to avoid trapping of fluid within the recess by the projection, the surfaces of rotation of the first and second rotors cooperating over a substantial arc of rotation of the two rotors to define a fluid barrier therebetween to separate the working chamber into an inlet chamber and an outlet chamber, said inlet being positioned to direct said fluid into said inlet chamber generally in the direction that the fluid moves around the surface of the first rotor away from said inlet chamber and said outlet being oriented to face the direction in which the fluid moves around the surface of the first rotor into said outlet chamber, wherein said means for synchronizing rotation of the rotors comprises first and second intermeshing gears within the casing, the first rotor and the first gear comprising an integrally molded plastics unit having a hollow cylindrical center portion and the second rotor and the second gear comprising an integrally molded plastics unit having a hollow cylindrical center portion and wherein said casing is comprised of two casing halves of plastics material having parallel cylindrical hub portions integral with said casing halves and disposed in the respective hollow cylinders central portions of said units with at least one of said casing halves having an aperture extending through the hub disposed in one of said units and a shaft secured to said one of said units and extending outwardly of the casing through said aperture.

* * * * *